US006993139B2

(12) United States Patent
Hara

(10) Patent No.: US 6,993,139 B2
(45) Date of Patent: Jan. 31, 2006

(54) METHOD OF AND APPARATUS FOR DECODING AUDIO DATA

(75) Inventor: Tetsuya Hara, Tokyo (JP)

(73) Assignee: Renesas Technology Corp., Tokyo (JP)

( * ) Notice: Subject to any disclaimer, the term of this patent is extended or adjusted under 35 U.S.C. 154(b) by 577 days.

(21) Appl. No.: 09/931,855

(22) Filed: Aug. 20, 2001

(65) Prior Publication Data

US 2002/0141596 A1 Oct. 3, 2002

(30) Foreign Application Priority Data

Apr. 3, 2001 (JP) ..... 2001-104563

(51) Int. Cl.
*H04R 5/00* (2006.01)

(52) U.S. Cl. ..... 381/22; 700/94; 386/96; 386/98; 704/500

(58) Field of Classification Search ..... 381/2, 381/22, 18; 700/94; 704/500–504; 386/95, 386/96, 97, 98, 99, 83; 348/512, 515, 518, 348/416, 558

See application file for complete search history.

(56) References Cited

U.S. PATENT DOCUMENTS 5,966,385 A * 10/1999 Fujii et al. ..... 370/465
2003/0189879 A1 * 10/2003 Ishii et al. ..... 369/30.03

FOREIGN PATENT DOCUMENTS

JP 2000-278136 10/2000

OTHER PUBLICATIONS

U.S. Appl. No. 09/399,368, filed Jun. 5, 2001, Vramoto.

* cited by examiner

*Primary Examiner*—Vivian Chin
*Assistant Examiner*—Corey P. Chau
(74) *Attorney, Agent, or Firm*—Leydig, Voit & Mayer, Ltd.

(57) ABSTRACT

An audio decoding apparatus includes a CPU which groups received sample data into one block. Furthermore, the CPU adds control information relating to attributes to data of each block.

12 Claims, 8 Drawing Sheets

10
20
DIGITAL NTSC/PAL ENCODER
30a
AUDIO D/A CONVERTER
30b
AUDIO D/A CONVERTER
30c
AUDIO D/A CONVERTER
40
DIGITAL AUDIO INTERFACE RECEIVER
15
VIDEO DISPLAY INTERFACE SECTION
DSP・CPU DATA BUS
17
AUDIO SIGNAL CONVERTER
SDRAM WRITE BUS
SDRAM READ BUS
18
SDRAM INTERFACE SECTION
16
SDRAM
14
VIDEO DECODER
12
STREAM INTERFACE SECTION
13
CPU
11
FRONT END SECTION
A/V SIGNAL

METHOD OF AND APPARATUS FOR DECODING AUDIO DATA

FIELD OF THE INVENTION

This invention relates to a technology for decoding digital audio data.

BACKGROUND OF THE INVENTION

FIG. 7 is a block diagram showing a schematic structure of a conventional audio decoding apparatus. This audio decoding apparatus has the decoding section 1, data buffer 2, and output section 3. The decoding section 1 receives and decodes a coded digital audio data stream, such as Dolby AC-3, read from a recording medium of digital audio data, such as a DVD (Digital Video Disc), and outputs PCM audio data. The PCM audio data output from the decoding section 1 are temporarily stored in the data buffer 2 so as to cope with synchronization with image information and a fluctuation in an input bit rate of the digital audio data stream or the like. The output section 3 receives the PCM audio data from the data buffer 2 and outputs audio serial data to an D/A (digital/analog) converter or the like or output digital audio data into a digital audio interface receiver. If the digital audio data stream has multi-channels, the output section 3 outputs time series data (PCM audio data) output from the decoding section 1 into a plurality of digital/analog converters corresponding to respective channels or to a plurality of digital audio interface receivers.

FIG. 8 shows a structure of the PCM audio data output from the decoding section 1, namely, shows a data structure in the case of Dolby AC-3 6-channel output. As shown in FIG. 8, one sample data is comprised of PCM audio data of respective channels to be output at the same time. Namely, since the Dolby AC-3 6-channel adopts 6-channel output, one sample data is composed of six PCM audio data. A plurality of sample data compose an audio frame. A number of sample data (audio frame length) per one audio frame is determined by an audio decoding method, and for example in the case of Dolby AC-3, one audio frame is composed of 1536 sample data.

Incidentally, after being decoded in the decoding section 1, if the PCM audio data which are time-series data are given directly to the output section 3, there arises a problem, mentioned below. Namely, if the attribute of the PCM audio data to be given to the output section 3 changes dynamically, data output from the output section 3 cannot cope with the dynamic change of the attribute. Moreover, after transmission of the digital audio data stream is started, in the case, for example, if an error occurs and the re-synchronizing process is desired to be executed, it is necessary to initialize all the decoding section 1, the data buffer 2 and the output section 3 and to return to the initial state so as to restart the transmission.

The inventors of this invention have disclosed an audio decoding apparatus in Japanese Patent Application Laid-Open No. 2000-278136 that takes care of this problem. In this audio decoding apparatus, as shown in FIG. 9, tag data representing individual attributes are added to respective PCM audio data. As a result, the output section can cope with a dynamic change of attributes, and the re-synchronizing process can be executed accurately.

However, in case of the audio decoding apparatus disclosed in Japanese Patent Application Laid-Open No. 2000-278136, memory requirement or bus transmission requirement increases because of the additional tag data added to each of the PCM audio data. For example, if the PCM audio data are 24 bits and the tag data are 8 bits, then total PCM audio data becomes 27 Kbytes and total tag data becomes 9 Kbytes for one audio frame (1 K byte=1024 bytes). Thus, in this example, the total memory requirement and bus transmission requirement becomes 36 K bytes.

SUMMARY OF THE INVENTION

It is an object of the present invention to provide a method of and an apparatus for decoding audio data which are capable of coping with a dynamic change in data attributes and a re-synchronizing process while increases in required memory capacity and bus transmission capacity are suppressed as much as possible.

According to the present invention, received audio data that contains a plurality of coded sample data are grouped into one block; control information relating to attribute is added to the data of each block; the control information added data of each block is temporarily stored and then output.

Other objects and features of this invention will become apparent from the following description with reference to the accompanying drawings.

DESCRIPTION OF THE PREFERRED EMBODIMENTS

Embodiments of a method of and an apparatus for decoding audio data according to the present invention will be explained below with reference to accompanying drawings.

Figure 1:
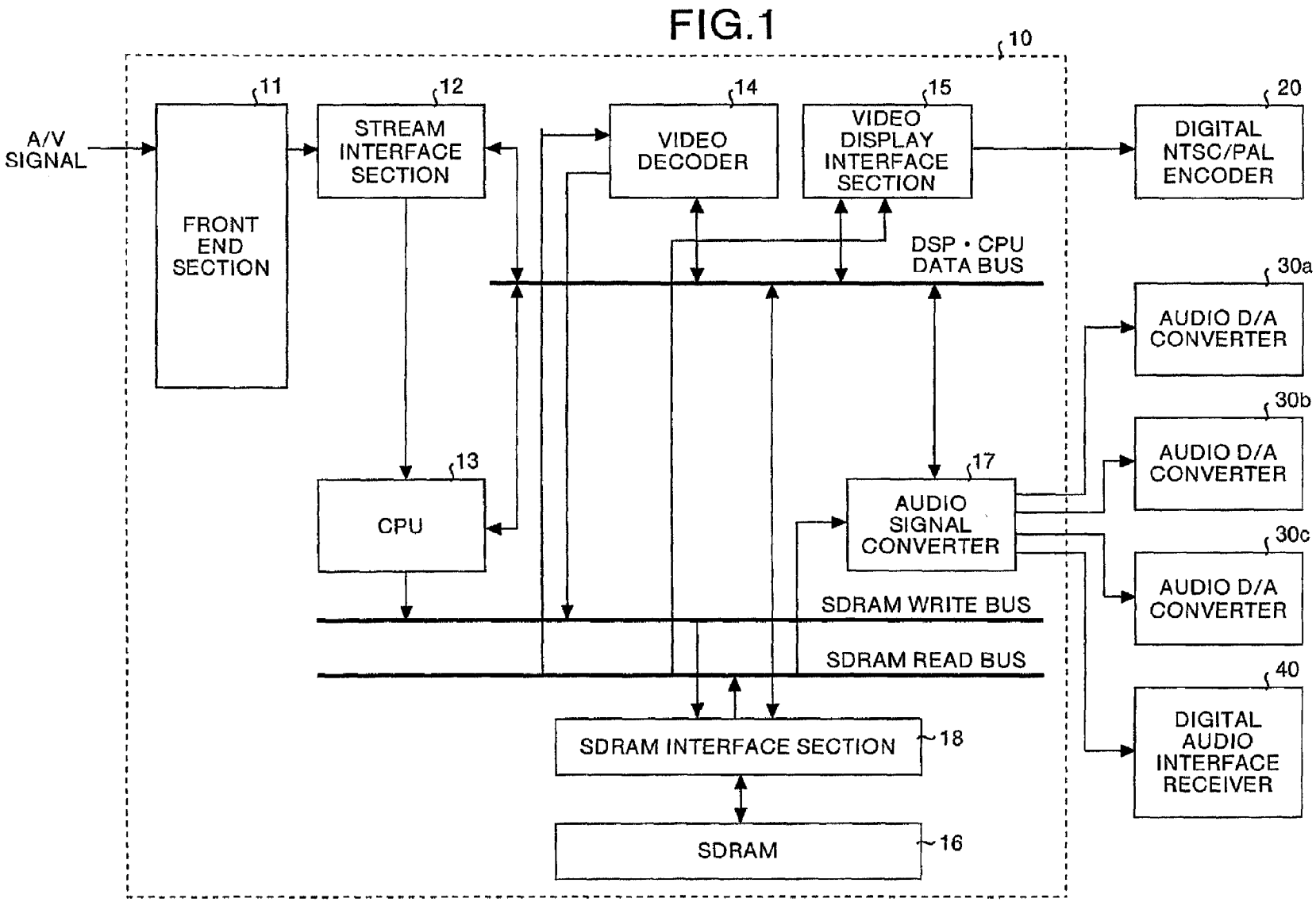
FIG. 1 is a block diagram showing a structure of a audio video decoding apparatus according to an embodiment of the present invention.

FIG. 1 is a block diagram showing a structure of an audio video decoding apparatus according to one embodiment of the present invention. This audio video decoding apparatus 10 is provided with the front end section 11, stream interface section 12, CPU 13, video decoder 14, video display interface section 15, synchronous dynamic semiconductor storage device (hereinafter, SDRAM) 16, and audio signal converting section 17.

The front end section 11 reads an A/V signal to be given from a recording medium such as DVD or data communication, and executes a signal process such as error correction. The stream interface section 12 receives a signal from the front end section 11, and converts this signal into bit-length data which are easily subject to the decoding process.

The CPU 13 receives data from the stream interface section 12, and executes a stream separating process for separating the data into video stream data and audio stream data, or a hardware operation timing control process. Further, this CPU 13 decodes the separated audio stream data and adds control information, mentioned later, to the PCM audio data which were subject to the decoding process.

The video decoder 14 receives the video stream data separated in the CPU 13 and decodes them. The video display interface section 15 receives video data which are decoded in the video decoder 14, and outputs them to a digital NTSC/PAL encoder 20.

The SDRAM 16 operates as a buffer of PCM audio data and as an elementary stream buffer of video data. The PCM audio data and the video data are given via a SDRAM interface section 18.

Figure 2:
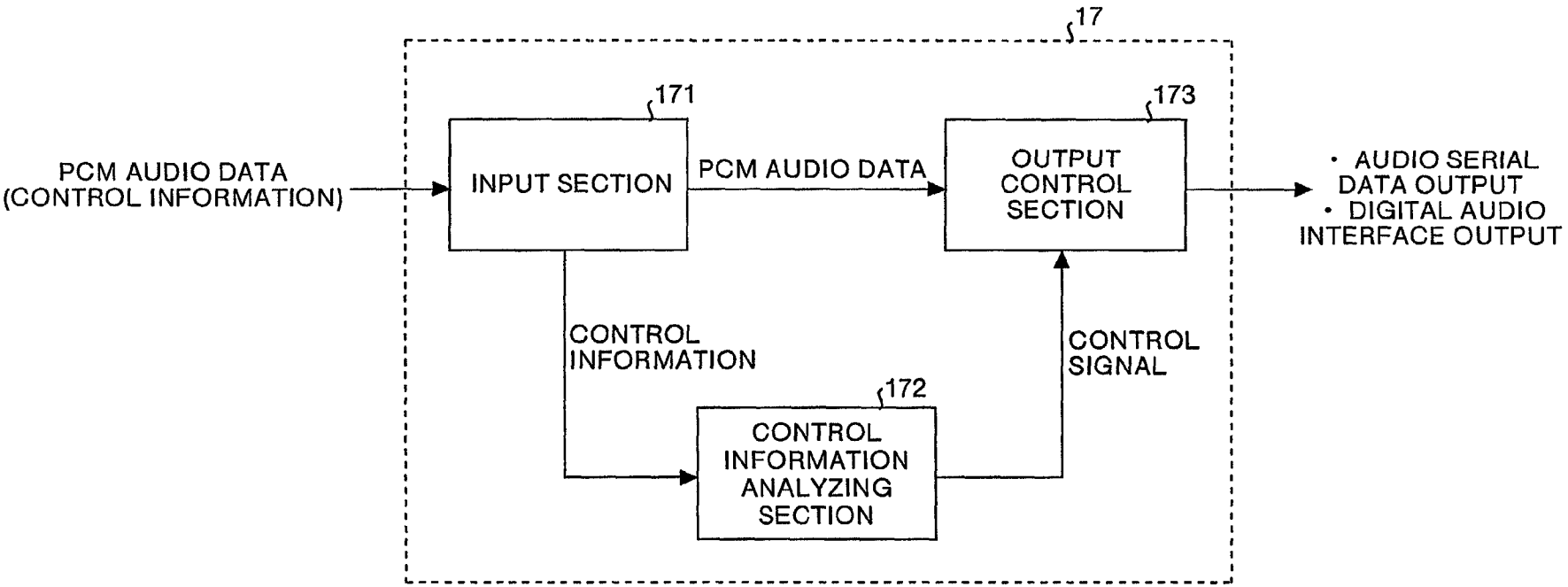
FIG. 2 is a block diagram showing a detailed structure of an audio signal converter shown in FIG. 1.

The audio signal converting section 17 receives PCM audio data from the SDRAM 16, and outputs the PCM audio data to audio D/A converters 30*a*, 30*b* and 30*c* and an digital audio interface receiver 40 based on the control information (audio serial data output and digital audio interface output). As shown in FIG. 2, the audio signal converting section 17 of the present embodiment is constituted so as to have an input section 171, a control information analyzing section 172 and an output control section 173. The input section 171 receives the PCM audio data to be given from the SDRAM 16, and separates the PCM audio data into PCM audio data itself and control information. The control information analyzing section 172 analyzes control information to be given from the input section 171, and gives a control signal to the output section based on the analyzed result. The output control section 173 converts the PCM audio data from the input section 171 properly based on the control signal from the control information analyzing section 172 and outputs the data.

In the structure of the above audio video decoding apparatus 10, the CPU 13 corresponds with the decoding section, and the SDRAM 16 and the interface section correspond to the storage section, and the audio signal converting section 17 corresponds to the output section.

Figure 3:
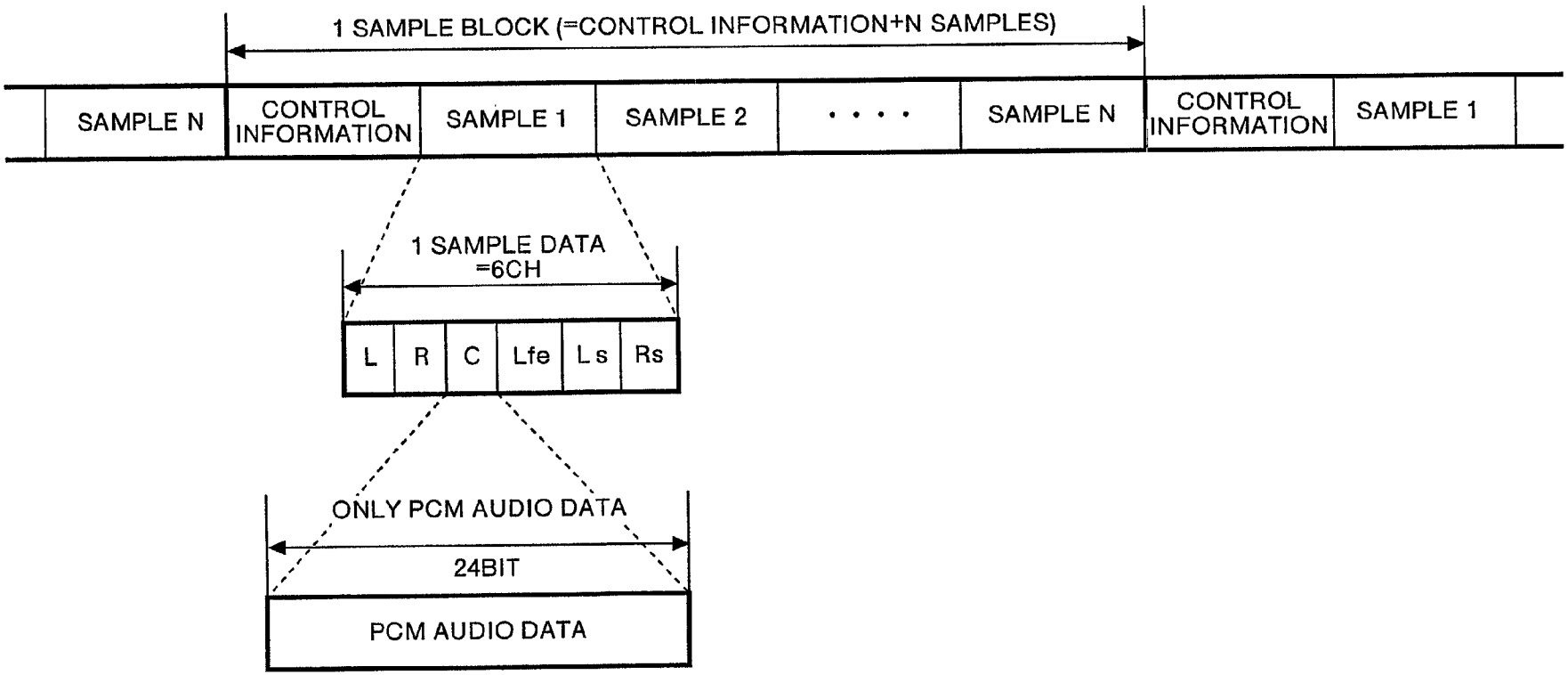
FIG. 3 is a schematic diagram showing a structure of PCM audio data to be output from a CPU shown in FIG. 1.
Figure 8:
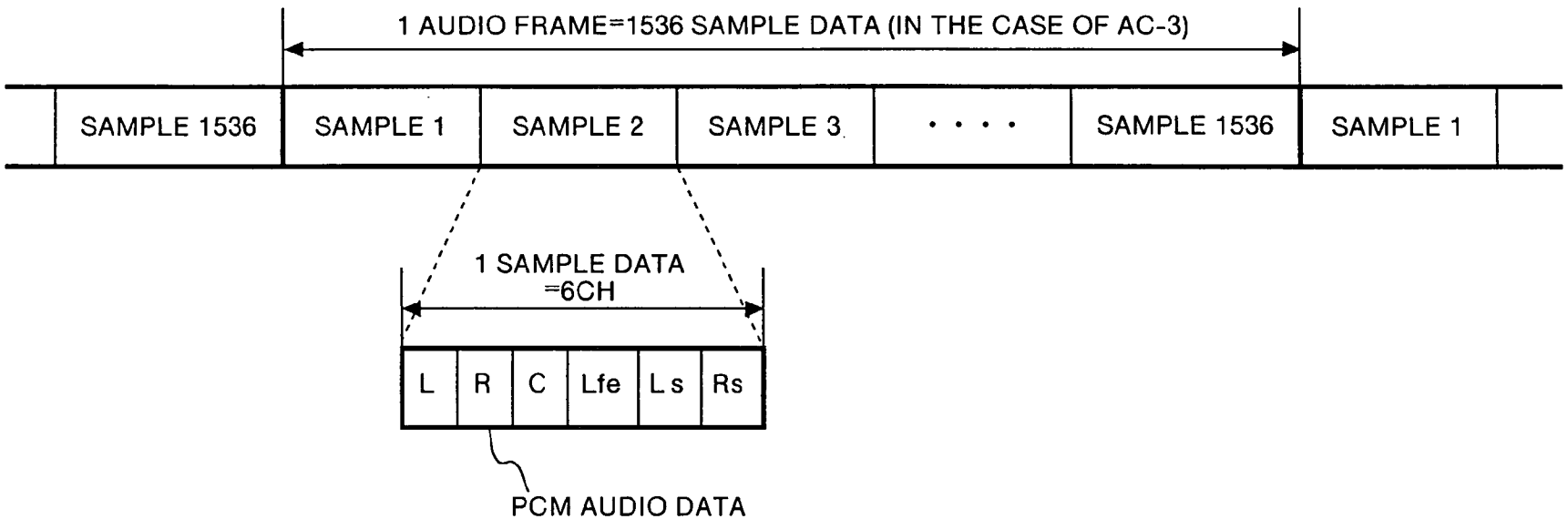
FIG.8 PRIOR ART
FIG. 8 is a schematic diagram showing a structure of a general multi-channel audio data string.

FIG. 3 shows a structure of the PCM audio data to be output from the CPU 13 according to the present embodiment. Similarly to FIG. 8, FIG. 3 exemplifies the data structure in the case of DolbyAC-3 6-channel output. In FIG. 3, sample data are composed of PCM audio data which of respective channels are output at the same time. Therefore, in Dolby AC-3 6-channel, one sample data is composed of six PCM audio data. A plurality of sample data form an audio frame. A number of sample data for one audio frame (audio frame length) is determined by an audio decoding method, and for example, in the case of Dolby AC-3, one audio frame is composed of 1536 sample data.

As is clear from FIG. 3, in the above audio video decoding apparatus 10, when PCM audio data are output from the CPU 13, a plurality of sample data are blocked (i.e. grouped into blocks), and the above-mentioned control information is added to the respective blocked sample data.

Figure 4:
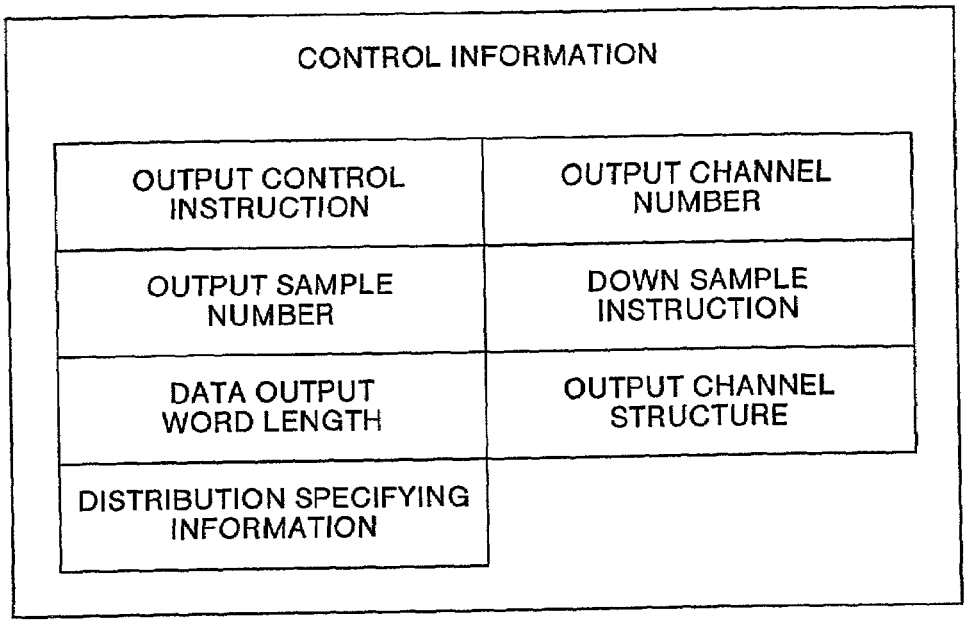
FIG. 4 is a key diagram showing a structural example of control information.

The control information represents attributes of a plurality of blocked sample data, and as shown in FIG. 4, for example, it includes output control instruction information, output channel number information, output sample number information, down sample instruction information, data output word length information, output channel structure information, distribution specifying information and the like.

Figure 5:
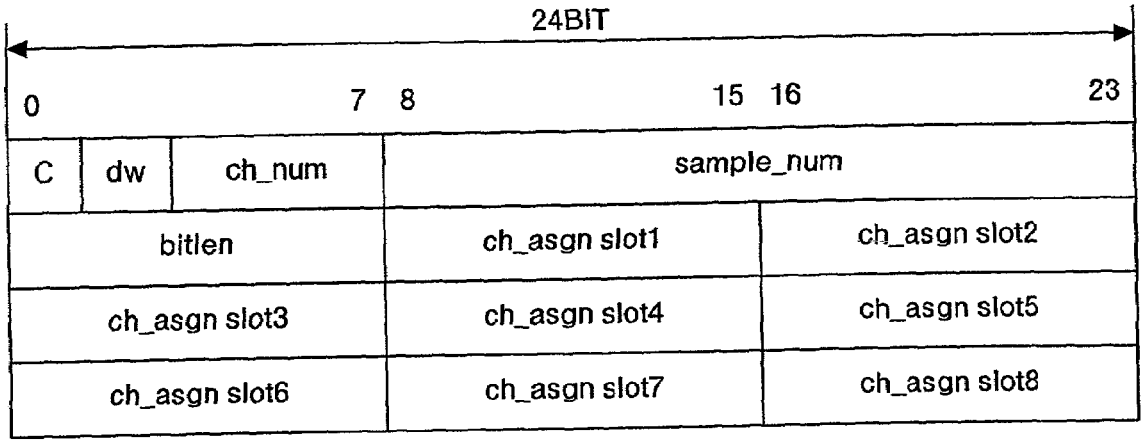
FIG. 5 is a schematic diagram showing a format example of control information.

The output instruction information is for instructing as to whether or not outputs of the sample blocks can be started/stopped, and in FIG. 5, it corresponds to c bit. In the audio signal converting section 17, if the output instruction information is included in the control information, a judgment is made as to whether or not the outputs can be started/stopped so that the sample data output operation timing can be controlled. Therefore, even if, for example, an error occurs, the output operation can be restarted by using the sample block including the output instruction information as a re-synchronizing point, and sound information and image information can be re-synchronized very easily without initializing all the CPU 13, the SDRAM 16 and the audio signal converting section 17.

The output channel number information is for showing a number of channels to which data are output for one sample data, namely, a number of PCM data to be read from the SDRAM 16 for one sample data. In FIG. 5, this information corresponds to ch_num. In the audio signal converting section 17, if the output channel number information is included in the control information, a number of the PCM audio data to be read and output from the SDRAM 16 for one sample data can be recognized. As a result, even if a number of the output channels changes dynamically, the output can cope with this situation. Furthermore, since the audio signal converting section 17 can recognize a number of the PCM audio data to be read and output from the SDRAM 16, a reading control mechanism or the like of the SDRAM 16 can be simplified.

The output sample number information is information for showing a number of blocked samples, and in FIG. 5, it corresponds to sample_num. In the audio signal converting section 17, if the output sample number information is included in the control information, a number of samples in the sample blocks can be recognized. As a result, a data length of the sample blocks is calculated based on the output channel number information if necessary, and the control information can be detected securely. As a result, even if a number of sample data in the sample blocks and a number of output channels for one sample change dynamically, the output can cope with this situation.

The down sample instruction information is for instructing as to whether or not down sampling is executed, and in FIG. 5, it corresponds to dw bit. The audio signal converting section 17 is in the audio video decoding apparatus 10 which can output both audio serial data and digital audio interface. In this case, sampling frequencies fs of both the outputs are occasionally different from each other. For example, if the sampling frequency of audio serial data is 96 KHz and that of digital audio interface is 48 KHz, it is necessary to ½ down-sample PCM audio data of the digital audio interface output, and a number of the PCM audio data read from the SDRAM 16 for one sample changes. In the above-mentioned audio signal converting section 17, if the down sample instruction information is included in the control information, even if the sampling frequency of the digital audio interface output, for example, changes dynamically and down sample changes, a number of the PCM audio data read from the SDRAM 16 is calculated based on the down sample instruction information so that this audio signal converting section 17 can cope with this situation.

The data output word length information is for representing an output word length of the PCM audio data, and it corresponds to bitlen in FIG. 5. In the audio signal converting section 17, if the data output word length information is included in the control information, even if the output word length of the PCM audio data changes dynamically, the shift operation timing at the time of output is changed based on the data output word length information so that the audio signal converting section 17 can cope with this situation. In general, if the output word length of the PCM audio data changes dynamically, a method of changing the output word length of the PCM audio data itself output from the CPU 13 is considered. However, in this case, a shift operation is required for the PCM audio data once generated, and thus a processing amount of the CPU 13 increases remarkably. On the contrary, if the output word length of the PCM audio data is changed in the audio signal converting section 17 as mentioned above, the audio signal converting section 17 can cope with this situation by changing the shift operation timing at the time of output without adding special hardware. For this reason, a processing amount in the CPU 13 can be reduced.

Further, as for the data output word length information, if the audio serial data output and the digital audio interface output are executed, a field is provided to bitlen and both the information is held. As a result, even if the output word lengths are different from each other in the same sample data, this problem can be solved.

The output channel structure information is for representing an order of the PCM audio data in one sample data. The distribution specifying information is for specifying internal distribution in the PCM audio data. In FIG. 5, the output channel structure information and the distribution specifying information correspond to ch-asgn slot 1 through 8. In this example, the slot numbers of the channel structure information are fixed. The CPU 13 sets an output order of the PCM audio data in one sample data as the output channel structure information, and outputs the PCM audio data in respective sample data according to the output order. If a slot number of the channel structure is smaller than a number of the PCM audio data in one sample data, information showing unused is set in slots not to be used. For example, in the case of 6-channel output, as for the channel structure information, slot 1 through slot 6 are set as L, R, C. Lfe, Ls and Rs, and slot 7 and slot 8 are set as unused. The PCM audio data output from the CPU 13 are output in an order of L, R, C. Lfe, Ls and Rs per sample data. The PCM audio data are read from the SDRAM 16 based on the ch_num value for each sample data in the audio signal converting section 17, and the PCM audio data are distributed to corresponding channels in such a manner that the first PCM audio data is distributed to L channel according to the slot 1 information, the second PCM audio data is distributed to R channel according to the slot 2 information and on. If internal distribution specification exists, this is also executed. For example, if the PCM audio data for L and R are output to the digital audio interface output, information showing distribution to the digital audio interface output is added to slot 1 and slot 2, whereas the first PCM audio data is distributed to L channel and also to the digital audio interface output in the audio signal converting section 17.

In the audio signal converting section 17, if the output channel structure information is included in the control information, since the channel structure which outputs the PCM audio data can be recognized, the audio signal converting section can cope with a case where the output channel structure changes dynamically. Moreover, if the distribution instruction information is included in the control information, in the audio signal converting section 17, one PCM audio data can be distributed to a plurality of output channels. Therefore, in the case of, for example, an audio serial data output and a digital audio interface output at the time of 2-channel output, namely, the same PCM audio data are output to a plurality of output channels, one PCM data can be eliminated from the CPU 13, and required memory capacity and bus transmission capacity can be further reduced.

Figure 6:
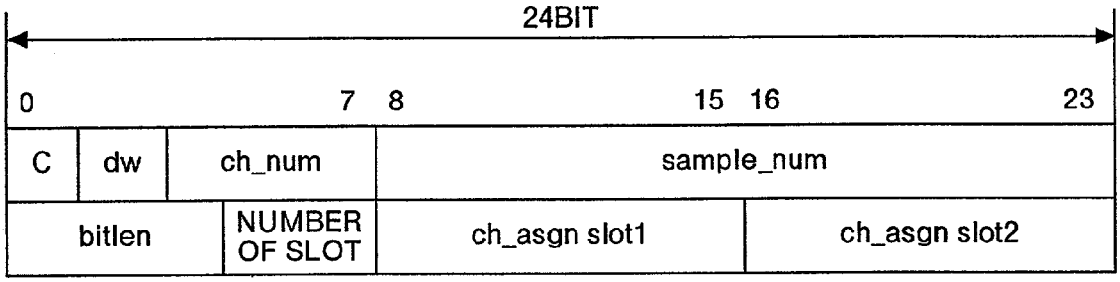
FIG. 6 is a schematic diagram showing another format example of control information.
Figure 7:
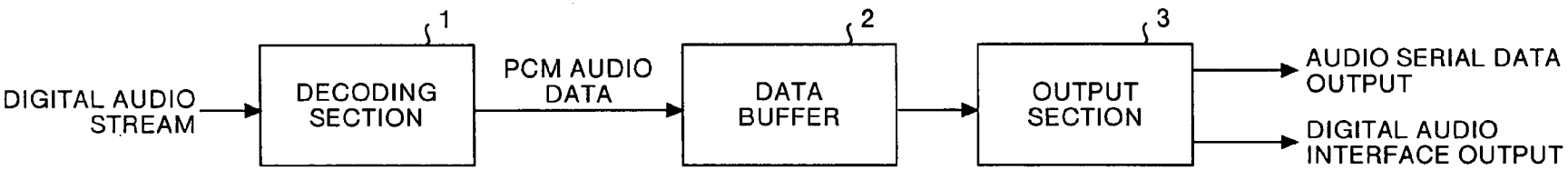
FIG.7 PRIOR ART
FIG. 7 is a block diagram showing a structure of a conventional audio decoding apparatus.

In the above example, the slot number of the channel structure information is fixed, but it can be varied according to the output channels. If the slot number of the channel structure is variable, as shown in FIG. 6, the slot number specifying information is added to the channel structure information, and pieces of the channel structure information which accords with the set slot number may be set. For example, if the slot number is 2, the channel structure information is composed of the slot number specifying information in which the slot number is set two, and the channel structure information of slot 1 and slot 2. In the audio signal converting section 17, a boundary between the control information and the PCM audio data is recognized by the slot number specifying information, and the output channels of the PCM audio data are set based on the information of slot 1 and slot 2.

As explained above, according to the present embodiment, since various control information is added when the PCM audio data are output from the CPU 13, the invention can cope with the dynamic change in data attributes and the re-synchronizing process. Further, in the present embodiment, a plurality of sample data are blocked and the control information is added to the blocked sample data respectively. For this reason, an increase in data amount accompanied by the addition of the control information is very small, and the increases in the memory capacity and bus transmission capacity can be suppressed as much as possible.

A number of sample data to which the control information is added is an arbitrary plural number. This is because the attributes such as the output channel structure does not frequently change in a unit of a sample, and there is a good possibility that the attributes of a plurality of PCM audio data are the same. Moreover, as frequency that sample data whose output can be controlled appear increases more, the sound information and the image information can be combined more finely at the time of the re-synchronizing process. However, an output period of the one audio sample data is very smaller than one screen output period of a video. Therefore, it is not necessary to add the control information to each one sample data and thus there arises no problem even if the control information is added to one of plural sample data.

Figure 9:
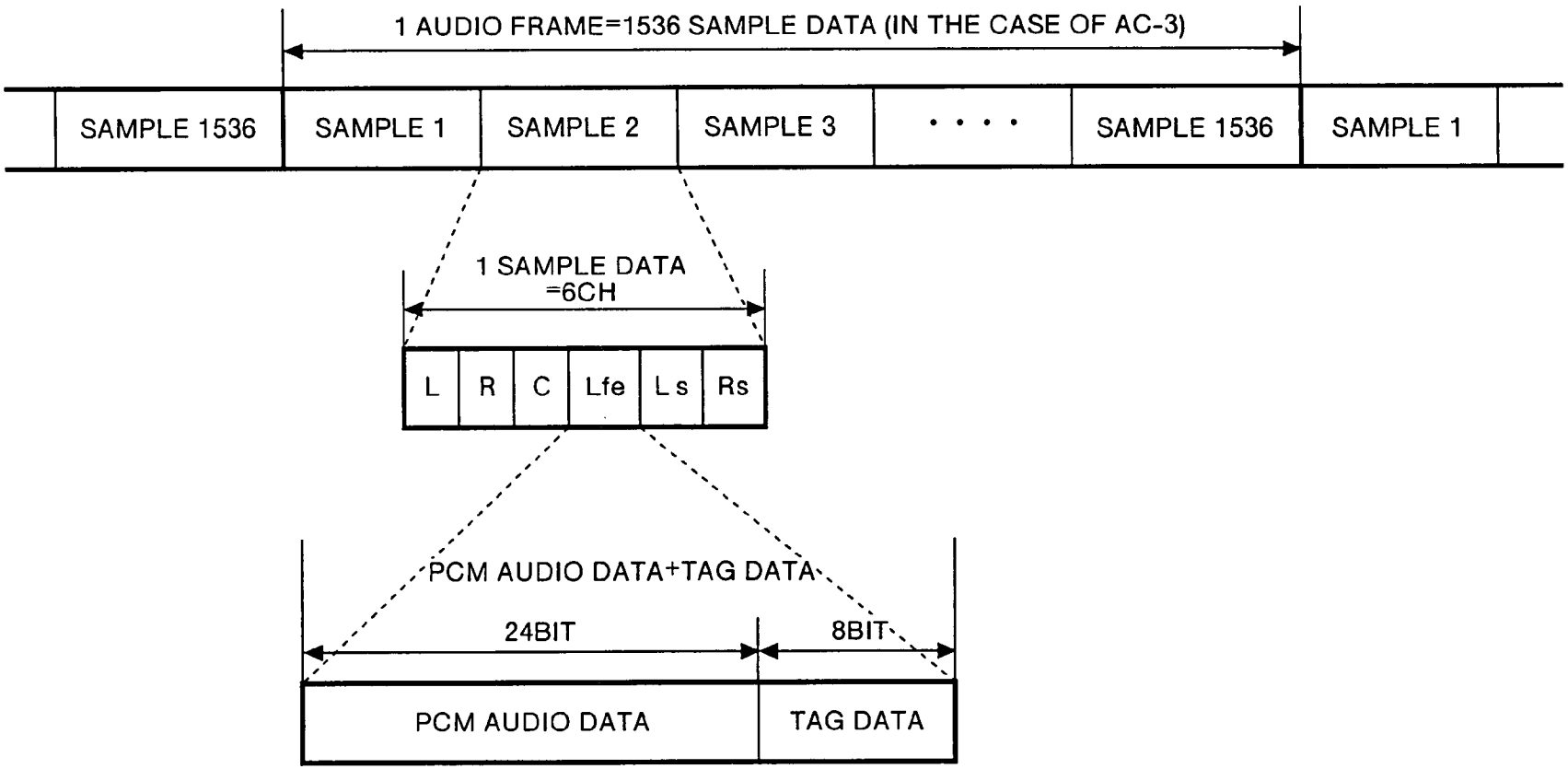
FIG.9 PRIOR ART
FIG. 9 is a schematic diagram showing the structure of PCM audio data output from a conventional audio decoding apparatus.

As the typical sample block, it is considered that, for example, one audio frame unit is sufficient on the system structure. Since the control information to be added shows only an attribute in the sample block, it can be composed of about several bytes. Therefore, if one audio frame is a sample block, in the structure of FIG. 3, the PCM audio data are 27 K bytes, and the control information is several bytes. As a result, this sample block can be suppressed to about ¾ in comparison with the conventional one (FIG. 9).

Actually, the attributes are not changed frequently even in audio frame unit, and the same attributes continue in overwhelmingly many occasions. For this reason, it is not always necessary to add the control information in one audio frame unit. For example, a judgment is made as to whether or not an attribute change in sample number unit preset in the CPU 13 (for example, one audio frame unit) exists and output control is necessary. When the judgment is made that both of them are not necessary, namely, that the control information is common, the control information is added to the one audio frame unit as one sample block. As a result, the increases in the memory capacity and the bus transmission capacity required as the SDRAM 16 can be suppressed further. In this case, sizes of the sample blocks are not necessarily fixed, but the sizes of the sample blocks may be different from one another suitably. Even if the sizes of the sample blocks are different from one another, the audio signal converting section 17 can cope with this situation based on the output sample number information. Therefore, there arises no problem.

As mentioned above, according to the method of this invention, since the control information relating to attributes is added to a plurality of blocked sample data, the increases in the required memory capacity and bus transmission capacity are suppressed as much as possible, and simultaneously the invention can cope with the dynamic change of data attributes and the re-synchronizing process.

According to the apparatus of this invention, since the control information relating to attributes is added to a plurality of blocked sample data, the increases in the required memory capacity and bus transmission capacity are suppressed as much as possible, and simultaneously the invention can cope with the dynamic change of data attributes and the re-synchronizing process.

Furthermore, since the control information relating to attributes are added to a plurality of sample data in frame data unit, the increases in the required memory capacity and bus transmission capacity are suppressed as much as possible, and simultaneously the invention can cope with the dynamic change of data attributes and the re-synchronizing process.

Furthermore, since a plurality of sample data whose attributes are equal are blocked and the control information relating to attributes are added to them, the increases in the required memory capacity and bus transmission capacity are suppressed as much as possible, and simultaneously the invention can cope with the dynamic change of data attributes and the re-synchronizing process.

Furthermore, since the control information including the information for instructing sample data whose output can be controlled is added to the blocked data, a judgment is made as to whether or not the output section can start/stop output so that the sample data output operation timing can be controlled.

Furthermore, since the control information including the channel number information to be output for one sample data is added to blocked data, the present invention can cope with a case where the output channel number for one sample data changes dynamically. Further, the output section can recognize a number of the PCM audio data read and output from the storage section, the reading control mechanism or the like of the storage section can be simplified.

Furthermore, since the control information including the sample data number information of blocked data is added to the blocked data, the present invention can cope with a case where the output channel number for one sample data changes dynamically.

Furthermore, since the control information including the information for specifying down sample is added to blocked data, the output control can cope with a case where a sampling frequency changes dynamically and down sample is changed in such a manner that a number of the PCM audio data read from the storage section is changed.

Furthermore, since the control information including the information for specifying a data output word length is added to the blocked data, the present invention can cope with a case where the output word length changes dynamically. Further, since the output section can cope with the change in the output word length, a processing amount of the decoding section does not increase.

Furthermore, since the control information including the information for specifying a plurality of data output word lengths is added to blocked data, the present invention can cope with a case where a plurality of output word lengths exist in one sample data.

Furthermore, since the control information including information for specifying an output channel structure is added to blocked data, the present invention can cope with a case where the output channel structure changes dynamically.

Furthermore, since the control information including information for specifying an output channel structure whose slot number is fixed is added to blocked data, the present invention can cope with a case where the output channel structure whose slot number is fixed changes dynamically.

Furthermore, since the control information including information for specifying an output channel structure whose slot number is variable according to output channels is added to blocked data, the present invention can cope with a case where the output channel structure whose slot number is variable changes dynamically.

Furthermore, since the control information including information for specifying internal data distribution of an output audio function is added to blocked data, one PCM audio data can be output to a plurality of output channels in the output section. If, for example, the same PCM audio data are output to a plurality of output channels, one PCM audio data may be output from the decoding section.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An audio decoding apparatus comprising:

a decoding unit which receives audio data including a plurality of coded sample data, decodes the sample data, groups respective pluralities of the sample data, after decoding, into respective blocks, and adds control information relating to attributes of the plurality of sample data in a respective block to the respective block;

a storage unit which temporarily stores the blocks; and an output unit which outputs the sample data of each block that has been temporarily stored, based on the control information added to the respective block, wherein said decoding unit groups sample data having identical attributes into one block.

2. The audio decoding apparatus according to claim 1, wherein said decoding unit groups each plurality of sample data into a respective block in frame units.

3. The audio decoding apparatus according to claim 1, wherein said decoding unit adds to the control information starting information that indicates sample data from which output control can be started.

4. The audio decoding apparatus according to claim 1, wherein said decoding unit adds, to the control information, channel information indicating number of channels that are to be output for each sample data.

5. The audio decoding apparatus according to claim 1, wherein said decoding unit adds, to the control information, information indicating a down sample.

6. The audio decoding apparatus according to claim 1, wherein said decoding unit adds, to the control information, length information indicating word length of data to be output.

7. The audio decoding apparatus according to claim 1, wherein said decoding unit adds, to the control information, length information indicating word length of data to be output when there are plurality of outputs.

8. The audio decoding apparatus according to claim 1, wherein said decoding unit adds, to the control information, channel information indicating formation of an output channel.

9. The audio decoding apparatus according to claim 1, wherein said decoding unit adds, to the control information, distribution information indicating data distribution of said output unit.

10. An audio decoding apparatus comprising:

a decoding unit which receives audio data including a plurality of coded sample data, decodes the sample data, groups respective pluralities of sample data, after decoding, into respective blocks, and adds control information relating to attributes of the plurality of sample data in a respective block to the respective block;

a storage unit which temporarily stores the blocks; and an output unit which outputs the sample data of each block that has been temporarily stored, based on the control information added to the respective block, wherein said decoding unit adds, to the control information number, information indicating number of sample data that have been grouped in one block.

11. An audio decoding apparatus comprising:

a decoding unit which receives audio data including a plurality of coded sample data, decodes the sample data, groups respective pluralities of sample data, after decoding, into respective blocks, and adds control information relating to attributes of the plurality of sample data in a respective block to the respective block;

a storage unit which temporarily stores the blocks; and an output unit which outputs the sample data of each block that has been temporarily stored, based on the control information added to the respective block, wherein said decoding unit adds, to the control information, channel information indicating formation of an output channel, and said decoding unit adds, to the control information, slot information indicating number of slots of the output channel.

12. The audio decoding apparatus according to claim 11, wherein the number of slots is variable.

* * * * *